United States Patent [19]

Hanson et al.

[11] Patent Number: 5,008,657

[45] Date of Patent: Apr. 16, 1991

[54] SELF ADJUSTING MATRIX DISPLAY

[75] Inventors: Charles M Hanson, Richardson, Tex.; Virginia N. MacDonald, Lansdale, Pa.

[73] Assignee: Varo, Inc., Garland, Tex.

[21] Appl. No.: 304,166

[22] Filed: Jan. 31, 1989

[51] Int. Cl.[5] ..... G09G 3/20

[52] U.S. Cl. ..... 340/766; 340/767; 340/781; 340/812

[58] Field of Search ..... 340/781, 783, 789, 812, 340/813, 713, 784, 793, 811, 718, 719, 766, 767; 358/241

[56] References Cited

U.S. PATENT DOCUMENTS 4,081,716 3/1978 Uemura ..... 313/63

4,471,347 9/1984 Nakazawa et al. ..... 340/811

4,586,039 4/1986 Nonomura et al. ..... 340/784

*Primary Examiner*—Alvin E. Oberley

*Assistant Examiner*—Steven J. Saras

*Attorney, Agent, or Firm*—Baker & Botts

[57] ABSTRACT

A video display (38) provides a visual representation of a video signal over a matrix of pixels (40). Each pixel comprises a picture element (64) operable to radiate responsive to an externally applied voltage determined by the video signal. To prevent the intensity of a selected picture element (64) from being dependent upon the threshold potentials of the switching elements connecting the externally applied voltage to the picture elements (64), feedback lines (46) are provided to sense the voltage at the picture element (64). The voltage at the picture element (64) is adjusted until it equals the desired voltage.

18 Claims, 2 Drawing Sheets

SELF ADJUSTING MATRIX DISPLAY

TECHNICAL FIELD OF THE INVENTION

This invention pertains in general to video displays, and more particularly to a video matrix display having a feedback circuit for adjusting the intensity of each pixel.

BACKGROUND OF THE INVENTION

Video displays normally consist of a matrix of pixels, the intensity of each pixel determined by the magnitude of a video signal applied to the pixel. In many cases, the pixels are randomly addressable in a row by column format.

In previously developed systems, the video signal is sequentially connected to each pixel, typically comprising a phosphor element, by means of logic circuitry for addressing the pixels. The intensity of the addressed pixel is dependent upon the magnitude of a current through the phosphor. The current through the phosphor depends upon the potential between the video signal applied to the pixel and the voltage at a common cathode.

In the prior art, the video signal is applied to each pixel through logic circuitry, such as MOSFETs. Each MOSFET has a threshold potential $V_t$ which determines the conductance between the source and drain of the MOSFET for a given gate voltage. Hence, the brightness of each pixel is dependent not only upon the video signal applied to that pixel, but also upon the threshold voltage of the particular MOSFET connecting the video signal to the pixel. Since the threshold potentials of all the MOSFETs in the matrix vary from one another, the actual voltage present at the phosphor element depends upon the particular MOSFETs in the connecting circuitry. Therefore, a constant video signal will generate a non-uniform display. This has the effect of creating false images and obscuring genuine images.

Therefore, a need has arisen in the industry to provide, a video display in which the actual intensity of each pixel is unaffected by electrical parameters in the switching circuitry.

SUMMARY OF THE INVENTION

In accordance with the present invention, a video display is provided which substantially eliminates or prevents the disadvantages and problems associated with prior video displays.

The video display of the present invention comprises a plurality of picture elements, or "pixels," each which emits radiation of intensity dependent upon an externally applied video signal. Upon application of the video signal to the picture element, a feedback circuit compares the actual intensity of each picture element to the video signal, and compensates for any variation due to the switching circuitry.

BRIEF DESCRIPTION OF THE DRAWINGS

For a complete understanding of the present invention and the advantages thereof, reference is now made to the following descriptions taken in conjunction with the accompanying drawings in which.

DETAILED DESCRIPTION OF THE INVENTION

Figure 1:
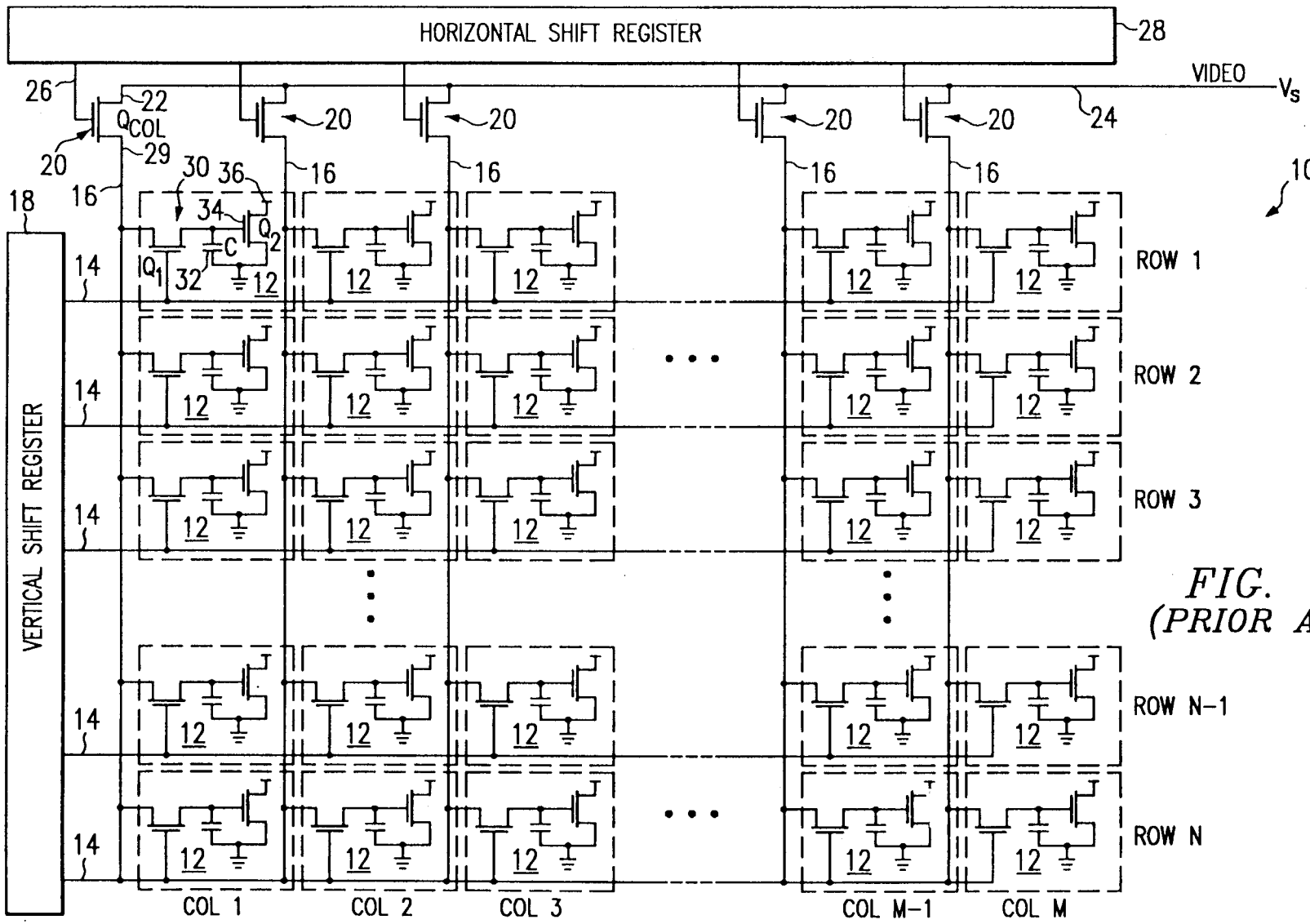
FIG. 1 (PRIOR ART)
FIG. 1 illustrates a circuit diagram of a prior art video display.
Figures 2, 3:
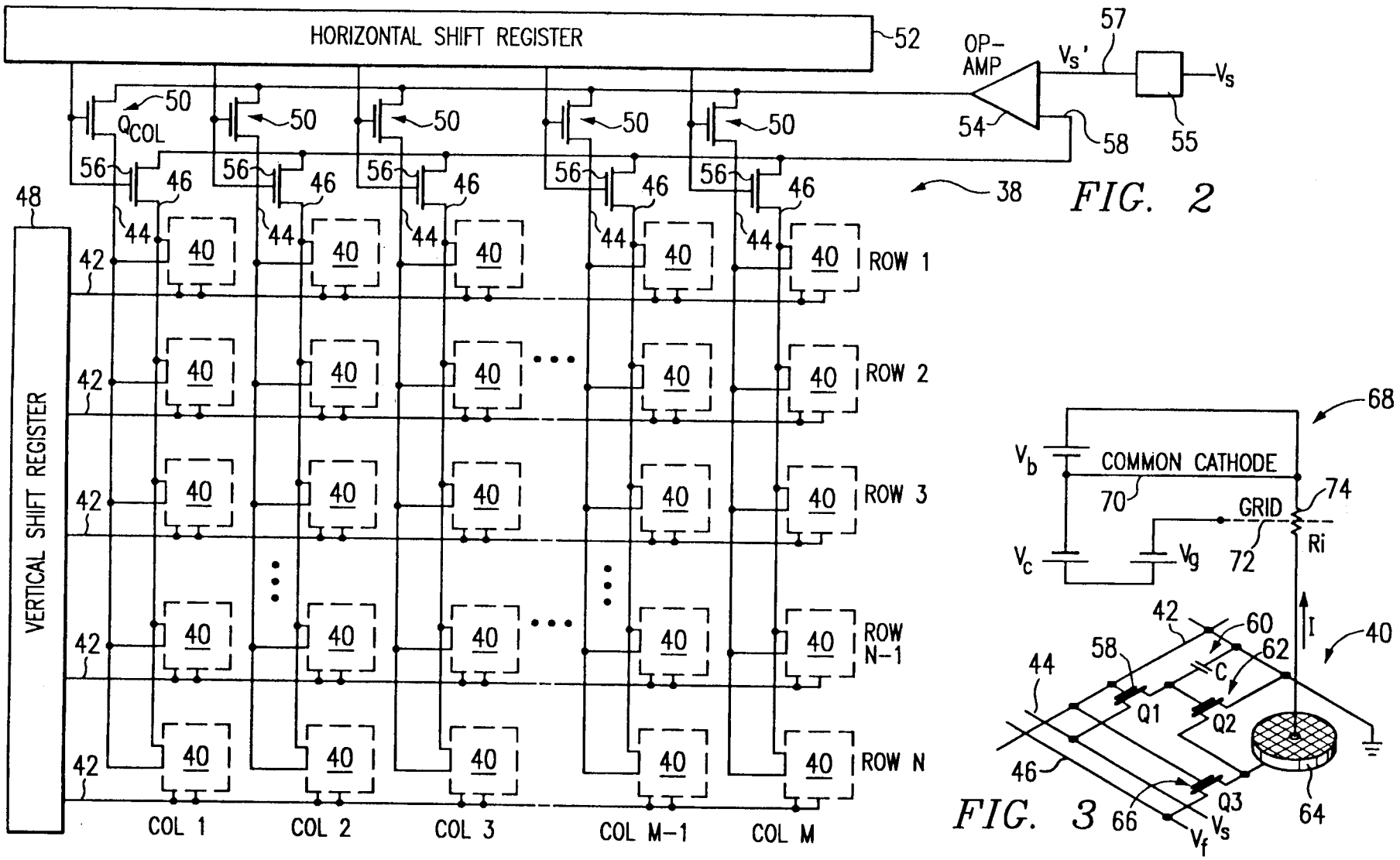
FIG. 2 illustrates a circuit diagram of the video display of the present invention.
FIG. 3 illustrates a circuit diagram of a pixel in the video display of the present invention.

The preferred embodiment of the present invention is best understood by referring to FIGS. 1–2 of the drawings, like numerals being used for like and corresponding parts of the various drawings.

FIG. 1 illustrates a circuit diagram of a prior art video display. The prior art video display 10 comprises a matrix of pixels 12 addressable by row and column lines 14 and 16, respectively. The rows 14 are connected to a vertical shift register 18. The columns 16 are connected to MOSFETs 20 having a source 22 connected to a video signal $V_s$ line 24, a gate 26 connected to a horizontal shift register 28 and a drain 29 connected to the column line 16.

Each of the pixels 12 comprises a MOSFET 30 having its gate connected to the row line 14, its source connected to the column line 16, and its drain connected to a first plate of a capacitor 32 and to the gate of another MOSFET 34. The source of the MOSFET 34 and the second plate of the capacitor 32 are connected to ground, and the drain of the MOSFET 34 is connected to a phosphor element 36.

In operation, the video signal $V_s$ is applied to the pixels 12 in sequential order by operation of the vertical and horizontal shift registers 18 and 28, respectively. To address the first pixel, a logical "1" is generated at the left most position of the horizontal shift register 28 and the top position of the vertical shift register 18. The logical "1" present on the row line 14 connected to the top position of the vertical shift register 18 causes all the MOSFETs 30 associated with the particular row line 14 to turn on, thereby providing a low impedance connection between the column lines 16 and the gates of the respective MOSFETs 34. A logical "1" is then generated in the left most position of the horizontal shift register 28, enabling the MOSFET 20 associated with that position. The enabled MOSFET 20 provides a low impedance path between the video signal $V_s$ and the associated column line 16, and consequently between the video signal $V_s$ and the gate of the MOSFET 34 associated with the selected row and column lines. Hence, the first plate of the capacitor 32 is charged to the potential of the video signal $V_s$ and that potential is simultaneously present at the gate of the MOSFET 34. The resulting voltage at the drain of the MOSFET 34, and therefore the voltage on the phosphor element 36, depends upon the magnitude of the video signal $V_s$ at the gate of the MOSFET 34, and the threshold voltage $V_t$ of the particular MOSFET 34.

Subsequently, each pixel 12 in the first row is addressed in the same manner as the logical "1" is shifted from left to right across the horizontal shift register. After the first row of pixels 12 has been addressed, the vertical shift register shifts the logical "1" to the second row, wherein all the pixels 12 on that row are sequentially addressed. The pixels are addressed sequentially on each row until all the rows are completed, at which time the process is repeated.

The brightness of each pixel 12 depends upon the voltage level at the phosphor element 36, which depends upon the magnitude of the video signal $V_s$ minus the voltage threshold $V_t$ of the MOSFET 34. The current through the phosphor element is depicted in greater detail in FIG. 3, in connection with the present invention.

Because the threshold voltages $V_t$ of the MOSFETs 34 of the various pixels 12 may vary in magnitude due to processing variations, a constant video signal $V_s$ applied to all the pixels 12 will result in a varied brightness of the pixels due to the variation in the $V_t'$ of the MOSFETs. The variation between the actual brightness of the pixels 12 and the applied video signal $V_s$ creates false images to be displayed and obscures genuine images. The effect is most pronounced at low voltage levels of $V_s$.

FIGS. 2 and 3 illustrate the video display circuit of the present invention which eliminates the variation in brightness due to the switching transistors. As best illustrated in FIG. 2, the video display 38 of the present invention comprises a row by column matrix of pixels 40 connected to row lines 42, column lines 44 and feedback lines 46. The row lines 42 are connected to a vertical shift register 48, and the column lines 44 are connected to the drain of a MOSFET 50 having a base connected to a horizontal shift register 52 and a source connected to the output of an operational amplifier 54. The video signal $V_s$ is connected to shifting circuitry 55 which outputs a modified video signal $V_s$. The modified video input signal $V_s'$ is connected to a first input 57 of the operational amplifier 54. The horizontal shift register 52 is also connected to the gates of MOSFETs 56 having the feedback lines 46 connected to their respective drains, and having their sources connected to the second input 58 of the operational amplifier 54.

Referring to FIG. 3, the pixel 40 is described in greater detail. The row line 42 is connected to the gate of a MOSFET 58 having its source connected to a respective column line 44 and its drain connected to the first plate of a capacitor 60 and the gate of a MOSFET 62. The second plate of the capacitor 60 and the source of the MOSFET 62 are connected to ground. The drain of the MOSFET 62 is connected to the phosphor element 64 and to the source of a MOSFET 66. The drain of the MOSFET 66 is connected to the respective feedback line 46 and the gate of the MOSFET 66 is connected to the respective row line 42.

The electron beam source 68 is shown schematically in FIG. 3 as comprising a cathode voltage source $V_c$ connected between ground voltage and a common cathode 70, a grid voltage source $V_g$ connected between ground and a grid 72, a beam voltage source $V_b$ connected across a common cathode 70, and a resistive element 74 having a resistive value of $R_i$ connected between the common cathode 70 and the phosphor element 64.

As described in connection with FIG. 1, the brightness of the phosphor element 64 will depend upon the current through the phosphor element 64. The current through the phosphor element 64 will be determined by the voltage on the common cathode 70 and the voltage at the drain of the MOSFET 62.

The video display 38 of the present invention controls the voltage at the drain of the MOSFET 62 by providing a feedback path through the MOSFET 66 and the feedback lines 46 to the operational amplifier 54.

In operation, a cell is addressed by providing a logical level "1" on the vertical shift register 48 and the horizontal shift register 52 as previously described in connection with FIG. 1. The enabled row line 42 causes the MOSFETs 58 associated with the particular row line 42 to be turned on, thereby providing a low impedance connection between the column line 44 associated with each pixel 40 on the selected row, and the gate of the MOSFET 62. The horizontal shift register 52 drives one of the MOSFETs 50 into a conducting state, thereby providing a low impedance path between the output of the operational amplifier 54 and the source of the MOSFET 58 of the pixel 40 associated with the enabled column line 44 and the enabled row line 42. Consequently, the output of the operational amplifier 54 is connected to the gate of the MOSFET 62 of the selected pixel 40 in the matrix.

When the row line 42 is enabled by the vertical shift register 48, the associated MOSFETs 66 are also driven into a conducting state between the source of the MOSFET 62 and the feedback line 46. Hence, as the output signal from the operational amplifier 54 drives the MOSFET 62, thereby controlling the voltage at the phosphor element 64, the voltage at the phosphor element 64, equal to the drain potential of the MOSFET 62, is fed back to the second input 58 of the operational amplifier 54 via the feedback line 46 associated with the pixel. The operational amplifier compares the feedback voltage $V_f$ to the modified video signal $V_s'$, and connects its output accordingly until $V_f$ bears a predetermined relationship to $V_s'$. The correction takes place in real time, before the horizontal shift register addresses the next column.

As can best be seen in FIG. 3, the current through the phosphor element 64 can be determined by the equation:

$$I=(V_c-V_f)/R_i$$

where $V_c$=the cathode (filament) potential

I=the current through the phosphor element 64

$R_i$=the effective resistance of vacuum and phosphor and $V_f$=source/drain potential of MOSFET 62 at the selected pixel.

Since the operational amplifier 54 forces $V_f$ to a value dependent upon the video signal $V_s'$, the current through the phosphor element 64 may be determined by the equation:

$$I=(V_c-f(V_s))/R_i$$

Consequently, the current through, and hence the brightness of, the selected pixel bears a fixed relationship to the video signal $V_s$. Since the function $f(V_s)$ is a parameter of the operational amplifier 54, the pixel brightness is independent of the individual pixel parameters; particularly, the pixel brightness is independent of the threshold voltages of the MOSFETs of the particular pixel 12.

In the illustrated embodiment, the output of the operational amplifier 54 is comparable to the video input $V_s$ of FIG. 1. In order to generate the modified video input $V_s'$, the actual video signal will normally be inverted and level-shifted, such that $V_s'$ has the desired relationship to the desired voltage at the selected picture element.

Although the present invention has been described in detail, it should be understood that various changes, substitutions and alterations can be made herein without departing from the spirit and scope of the invention as defined by the appended claims.

What is claimed is:

1. A video display for providing a visual representation of a video signal comprising:

a matrix of picture elements, each operable to emit radiation having an intensity responsive to a voltage applied thereto;

means for addressing a selected picture element to which said voltage is to be applied;

means for generating an input voltage responsive to the video signal at the addressed picture element;

means for sensing the magnitude of said voltage applied to said selected picture element; and means for adjusting said input voltage such that said voltage applied to said selected picture element has a predetermined relationship to the video signal.

2. The video display of claim 1 wherein said adjusting means comprises means for comparing said voltage at said selected picture element to a desired voltage having a predetermined relationship to the video signal.

3. The video display of claim 2 wherein said sensing means comprises switching means enabled by said addressing means for connecting said voltage at said selected picture element to said comparing means.

4. The video display of claim 2 wherein said comparing means comprises an operational amplifier having a first input connected to said desired voltage and a second input connected to said sensing means and having an output operable to indicate a voltage differential between said first and second inputs.

5. The video display of claim 4 wherein said generating means comprises switching means enabled by said addressing means for selectively connecting said picture elements to said output of said operational amplifier.

6. The video display of claim 1 wherein said addressing means comprises:

row and column lines associated with each picture element;

a first shift register connected to said row lines; and a second shift register connected to said column lines.

7. The video display of claim 6 wherein said sensing means comprises:

feedback lines associated with each of said column lines;

column feedback switching means enabled by said second shift register for providing a low impedance path between a selected feedback line and said adjusting means; and row feedback switching means for providing a low impedance path between a selected feedback line and said picture element associated with said selected feedback line and a selected row line.

8. The video display of claim 1 wherein said picture elements comprise phosphor.

9. The video display of claim 1 and further comprising means for generating a desired voltage dependent upon the magnitude of the video signal.

10. A video display for providing a visual representation of a video signal comprising:

a matrix of picture elements, each operable to emit radiation of an intensity responsive to an applied input voltage creating a current therethrough;

a plurality of row lines connected to ones of said picture elements;

a plurality of column lines connected to ones of said picture elements, such that a selected picture element may be addressed by a selected row line and a selected column line;

means for generating said input voltage at said selected picture element, the magnitude of said input voltage being dependent upon the magnitude of the video signal;

means for generating a desired voltage having a predetermined relationship to the video signal; means for comparing said desired voltage to said input voltage; and means for adjusting said input voltage such that a differential between said desired voltage and said input voltage is reduced.

11. The video display of claim 10 wherein said comparing means comprises an operational amplifier connected to said desired voltage and said input voltage.

12. The video display of claim 11 wherein said comparing means further comprises:

feedback lines connected between said picture elements and said operational amplifier for connecting said input voltage to said operational amplifier; and switching means for providing a low resistance path between said selected picture element and a selected feedback line.

13. The video display of claim 12 wherein said switching means comprises MOSFET transistors associated with the respective picture elements, each having a source connected to said picture element and a drain connected to one of the feedback lines.

14. The video display of claim 13 wherein the gates of the MOSFET transistors are connected to corresponding row lines.

15. A method of displaying a visual representation of a video signal on a plurality of individually addressable picture elements, comprising the steps of:

applying a voltage dependent upon the video signal to a selected picture element;

sensing the voltage at said selected picture element; and adjusting the voltage at said selected picture element towards a desired voltage having a predetermined relationship to the video signal.

16. The method of claim 15 and further comprising the steps of generating said desired voltage in a predetermined relationship to said video signal.

17. The method of claim 15 and further comprising the step of comparing the voltage present at said selected picture element to said desired voltage.

18. The method of claim 17 and further comprising the step of generating a voltage responsive to the differential between said selected picture element and said desired voltage.

* * * * *